US006405705B1

(12) United States Patent
Dunsworth et al.

(10) Patent No.: US 6,405,705 B1
(45) Date of Patent: Jun. 18, 2002

(54) METHOD AND APPARATUS FOR REDUCING LOCOMOTIVE DIESEL ENGINE SMOKE USING SKIP FIRING

(75) Inventors: Vincent F. Dunsworth, Edinboro; Eric R. Dillen; Shawn M. Gallagher, both of Erie, all of PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/575,337

(22) Filed: May 19, 2000

(51) Int. Cl.[7] ..... F02D 17/02
(52) U.S. Cl. ..... 123/305; 123/481
(58) Field of Search ..... 701/104, 105; 123/481, 198 F, 352, 357, 305

(56) References Cited

U.S. PATENT DOCUMENTS 4,530,332 A * 7/1985 Harvey et al. ..... 123/481
4,552,114 A * 11/1985 Sano et al. ..... 123/481
4,945,869 A 8/1990 Klomp
5,553,575 A 9/1996 Beck et al.
5,826,563 A 10/1998 Patel et al.

FOREIGN PATENT DOCUMENTS

JP 63-154840 A * 6/1988 ..... 123/481

* cited by examiner

*Primary Examiner*—Andrew M. Dolinar
(74) *Attorney, Agent, or Firm*—Carl A. Rowold; John L. DeAngelis, Jr.; Holland & Knight LLP

(57) ABSTRACT

A diesel engine, having a plurality of individually controllable fuel injected cylinders, is operated in a skip firing mode to reduce smoke emissions during low power operation. The system senses certain identified engine operating parameters and when these parameters exceed predetermined thresholds for a predetermined time, then the skip firing is implemented. In another embodiment, it is possible to implement several different skip firing patterns dependent upon engine performance. Upon implementation of skip firing, the engine timing angle is reset by a fixed angle and a multiplication factor is included in the speed loop integrator to ensure that the appropriate fuel volume value is injected into each cylinder immediately upon initiation of skip firing. Skip firing is then disabled when another set of predetermined conditions is satisfied.

1 Claim, 3 Drawing Sheets

METHOD AND APPARATUS FOR REDUCING LOCOMOTIVE DIESEL ENGINE SMOKE USING SKIP FIRING

BACKGROUND OF THE INVENTION

This invention relates to the control of a diesel engine, and more specifically, relates to the use of skip firing of the engine to reduce smoke emissions.

The technique of eliminating the firing of selected cylinders in an internal combustion or diesel engine is referred to as "skip firing". Removing the fuel supply (and/or spark ignition in a spark ignition engine) from these cylinders prevents them from firing. This technique has been used in the prior art to improve certain aspects of engine performance. When skip firing is initiated, the fuel quantity removed from the skipped cylinders must be added to the firing cylinders so that the performance parameters of the engine remain unchanged.

Large self-propelled traction vehicles, such as locomotives, typically use a diesel engine to drive a three-phase alternator (having a rotor mechanically coupled to the output shaft of the engine) for supplying electric current to one or more traction motors having rotors drivingly coupled (through speed reducing gearing) to axle-wheel sets of the vehicle. When excitation current is supplied to the field winding of the alternator rotor, alternating voltages are generated in the three-phase stator windings. The three-phase voltages are applied to input terminals of at least one three-phase, bi-directional power rectifier. If the locomotive has DC traction motors, then the rectified voltage is supplied to the parallel connected armature windings of the traction motors via a link. If the locomotive is equipped with AC rather than DC motors, then an inverter is interposed between the power rectifier and the traction motors to supply variable frequency power to the AC motors.

For the purpose of varying and regulating the speed of the diesel engine, it is common practice to equip the engine with a speed regulating governor that adjusts the quantity of pressurized diesel fuel injected into each engine cylinder. In this way, the actual speed (RPM) of the crank shaft is controlled and corresponds to a desired engine speed which is associated with the desired engine horsepower. In a typical electronic fuel injection system, the output signal from the speed regulating governor drives individual fuel injection pumps for each cylinder, thus allowing the controller to individually control the fuel value (i.e., amount of diesel fuel) injected into each cylinder. The desired engine speed and load is set by manually operating a lever or handle on the throttle that can be selectively moved through eight motoring steps or notches by the locomotive operator. In addition to the eight power notches, the handle has an idle.

When not in use, the locomotive is typically parked with its engine running, its throttle in the idle position, and its main alternator developing no power (i.e., because there is zero traction load). The typical idle speed is high enough to power all engine-driven auxiliary equipment. Further, to conserve fuel, it is also a known practice to reduce engine speed below the regular idle setting (i.e., to a preselected low idle speed) such as 335 RPM (so long as the desired engine performance parameters remain within appropriate tolerance limits). Although the low idle speed conserves fuel and reduces overall stress on the engine, it also causes the engine to generate excessive smoke. Specifically, at the idle or low idle notch position, there is a low fuel value (i.e., amount of fuel) injected into the cylinder each time the cylinder is fired and, more importantly from the standpoint of smoke generation, a lower fuel pressure.

Fuel injection pressure is critical to smoke formation. Fuel injected at higher pressures breaks up or atomizes better as it enters the combustion chamber. Better atomization allows air to mix with the fuel creating a higher air-fuel ratio. The higher air-fuel ratio locally within the cylinder fosters complete burning and low smoke production. On a specific fuel injection system with a defined pump, nozzle, cam profile, and operating speed, the injection pressure is governed by the injection duration. As the injection duration is extended within the cam profile, the injection pressure goes up. Idle conditions have two disadvantages regarding fuel pressure. First, idle conditions are unloaded, so injection durations are very short. Also, idle engine speeds are generally low, which create lower cam velocities. Both conditions significantly reduce the injection pressure, causing an increase in smoke production.

Engine components (i.e., cams, bearings, pumps, injectors, etc.) are designed to a maximum peak injection pressure limit. This prevents making mechanical changes to the fuel system to increase idle injection pressure, such as, a faster cam profile or smaller injector spray nozzle holes. Such design changes would raise peak injection pressure at all operating points. This is not desirable because at full load (notch 8), the peak injection pressure would then exceed design limits.

The recent enactment of environmental statutes and the promulgation of related regulations by the Environmental Protection Agency require reduction in smoke emissions from diesel locomotives. Locomotive manufacturers are therefore directing attention to reducing smoke emissions to comply with these regulations.

BRIEF SUMMARY OF THE INVENTION

The system and method of the present invention overcomes the limitations and disadvantages of the prior art with respect to the production of visible smoke during low power operations of diesel engines. By skip firing the diesel engine, the smoke emissions are reduced. But it is critical to determine the conditions under which skip firing can be implemented without adversely impacting the power required by the various locomotive systems. Even when the locomotive is parked at idle, certain auxiliary systems load the diesel engine and thus it is required that the engine operate at some minimal power output level. The present invention also provides an apparatus and method for overcoming engine speed transients caused by the initiation and termination of engine skip firing.

BRIEF DESCRIPTION OF THE DRAWINGS

The present invention can be more easily understood and the further advantages and uses thereof more readily apparent, when considered in view of the description of the preferred embodiments and the following figures in which.

DETAILED DESCRIPTION OF THE PREFERRED EMBODIMENTS

Figure 1:
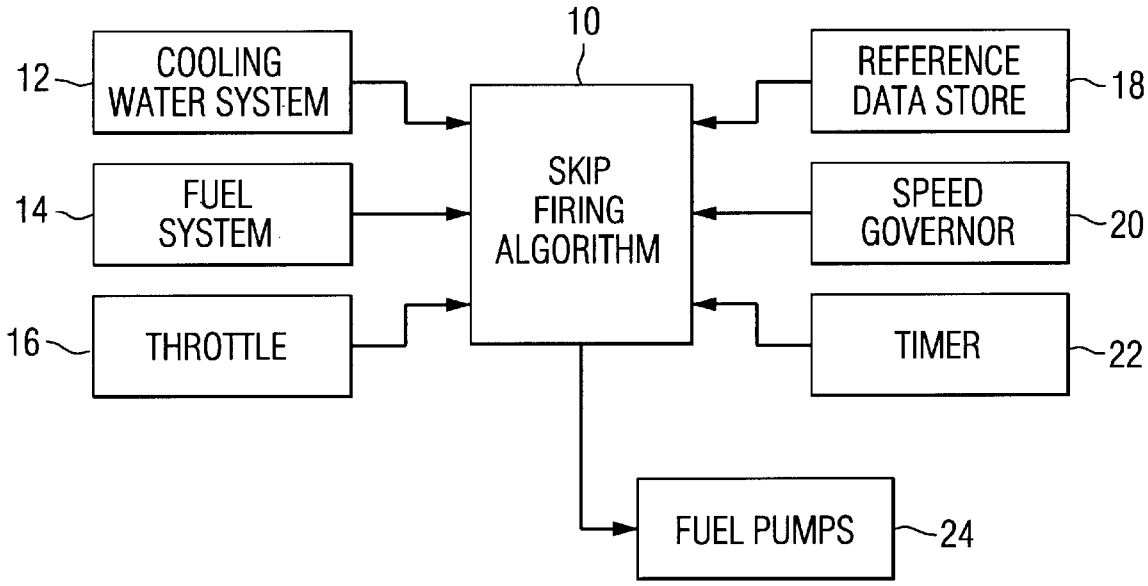
FIG. 1 is an engine controller implemented in accord with the teachings of the present invention.

Before describing in detail the particular skip firing mechanism in accordance with the present invention, it should be observed that the present invention resides primarily in a novel combination of processing steps and hardware related to a method and apparatus for reducing engine smoke using skip firing. Accordingly, these processing steps and hardware components have been represented by conventional processes and elements in the drawings, showing only those specific details that are pertinent to the present invention, so as not to obscure the disclosure with structural details that would be readily apparent to those skilled in the art having the benefit of the description herein.

As is known to those skilled in the art, in a medium-speed diesel locomotive engine, the cylinders are fired sequentially in a prescribed order. The order is determined by the mechanical configuration of the engine. Each cylinder can be fired only at a specific point during the rotation of the engine, and all cylinders fire within two crank shaft revolutions for four stroke engines. Skip firing involves selecting certain cylinders that will not be fired. The teachings of the present invention can also be applied to two stroke engines.

For example, in a conventional operational mode, the cylinders in General Electric V-16 engine (bearing model number 7FDL) are fired in the following order: 1R, 1L, 3R, 3L, 7R, 7L, 4R, 4L, 8R, 8L, 6R, 6L, 2R, 2L, 5R, 5L. The pattern then repeats. For simplicity in describing the skip firing mode, it is easier to assign a sequential number, 1–16, to each of the cylinders. In this case, the cylinders fire in the order: 1, 2, 3, 4, 5, 6, 7, 8, 9, 10, 11, 12, 13, 14, 15, 16. In this nomenclature, cylinder 1R is equivalent to number 1; cylinder 1L is equivalent to number 2, etc.

One possible skip firing pattern involves firing a cylinder and then skipping the next cylinder. The firing order for this skip firing pattern is: 1, 3, 5, 7, 9, 11, 13, 15, repeat. Because this pattern fires only the right bank of cylinders, it subjects the engine to unbalanced thermal loads. To overcome this problem, the skip firing pattern can be modified to: 1, 3, 5, 7, 9, 11, 13, 15, 2, 4, 6, 8, 10, 12, 14, 16, repeat. Although this skip firing pattern fires all cylinders in two crank shaft revolutions, it has two uneven firings. That is, after cylinder 15, two cylinders are skipped, but no cylinders are skipped after cylinder 16 fires. This skip firing pattern produces slightly uneven running of the diesel engine, although in some applications this may not be objectionable. Because this pattern fires half of the available cylinders during each revolution of the crank shaft, it requires injection of twice as much fuel into the fired cylinders to maintain output horsepower and engine speed.

The number of effective cylinders firing during two revolutions of the crank shaft can be expressed as the product of the total number of cylinders and the number of cylinders fired divided by the number available to be fired. In this case, the effective number of cylinders is: $16\times(8/16)=8$.

Another possible skip fire pattern fires one cylinder then skips two cylinders. This skip firing pattern can be described as follows: 1, 4, 7, 10, 13, 16, 3, 6, 9, 12, 15, 2, 5, 8, 11, 14, repeat. Note that this pattern provides uniform firing and reduces the number of effective cylinders to 5.33. This is calculated as follows: $16\times(1/3)=5.33$. In this embodiment, the amount of fuel injected into each cylinder is increased by a factor of three.

As is known to those skilled in the art, there are nearly an infinite number of skip firing patterns that can be utilized. Further, as is known to those skilled in the art, skip firing patterns can be developed and applied to many different engine types, including V-8 or V-12 engines, straight block engines, and also two stroke engines. The chosen pattern must give due consideration to the particular application, the requirement that cylinders be fired evenly, and vibration and thermal loads induced by the skip firing process. It has been found that the use of skip firing under certain conditions greatly reduces smoke emission at low diesel engine loads. Ancillary benefits of skip firing include the reduction of $NO_x$, CO, HC and particulates. It has also been found that skip firing may produce unacceptable engine vibration at higher engine speeds, and of course may prevent the diesel engine from delivering the required power output under high load conditions.

In the present invention, a method is described wherein skip firing is enabled as a function of certain engine operational parameters, including engine speed and fuel demand (i.e., cubic millimeters of fuel injected into each cylinder during each power stroke). FIG. 1 shows a software block 10, representing the functional software, responsive to certain input data, that initiates and terminates skip firing. The actual implementation of the skip firing method described herein may be in a microprocessor and associated memory within the diesel locomotive, so that the engine control block 10 may in fact represent a program stored in such memory and operable in such a processor. For instance, the skip firing algorithm of the present invention may be implemented in the engine control system for controlling the diesel engine of the locomotive or in the locomotive control system responsible for control and operation of the entire vehicle. In the latter case, skip firing signals are output from the locomotive control system to the engine control system and then to the fuel injection system for starting and stopping skip firing.

To effectuate the skip firing control scheme of the present invention, certain engine operational information is needed. The cooling water system 12 supplies the water temperature to the engine controller 10. The fuel system 14 provides the current fuel value. The throttle call notch position is provided as an input from a throttle 16. The software block 10 also requires certain reference data as input from a reference data store 18. This reference data includes a reference speed for each throttle notch position, as well as certain engine operational threshold values associated with initiating and terminating the skip firing process. A speed governor 20 supplies a signal representing the actual engine speed. Finally, a timer 22, which may be internal to the engine controller 10 in another embodiment, supplies a clock signal. The result computed by the skip firing algorithm of the present invention causes the software block 10 to send or not send firing signals to the fuel pumps 24 in accordance with the skip firing pattern selected.

Figure 2:
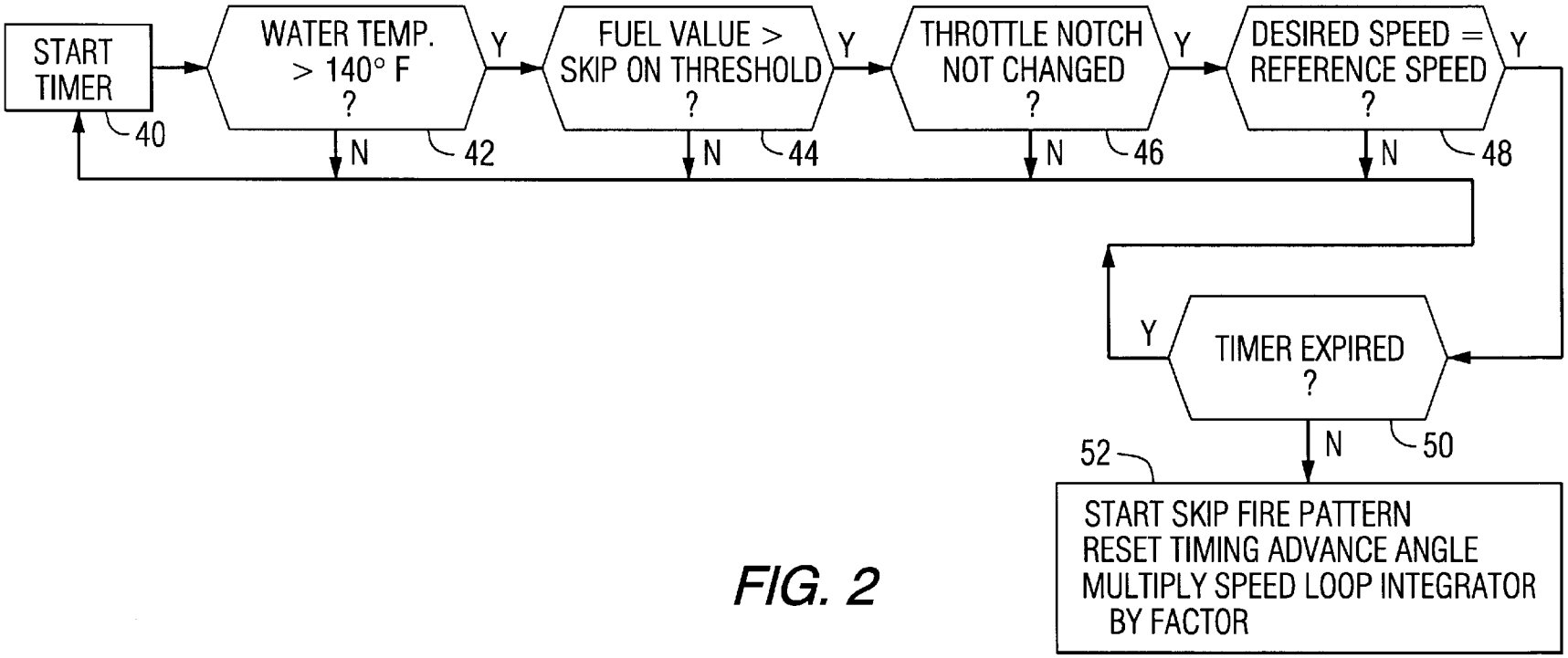
FIG. 2 is a flow chart illustrating the conditions under which skip firing is implemented.

The skip firing algorithm of the present invention, as executed by the software block 10, is illustrated in FIG. 2. At a step 40, the timer 22 is started. The timer 22 is set to a value to optimize the reduction of smoke and $NO_x$ emissions, and further to prevent the control system from reacting to short term engine transients. Without a timer, these transients could cause the engine to go into and out of skip firing for very short time periods, which is not necessarily advantageous and can appear as faulty engine operation to the locomotive operator. The specific value is dependent upon engine characteristics and the specific skip firing pattern to be implemented. At a step 42, the water temperature value is checked to determine whether the temperature is greater than 140° F. The purpose of the decision step 42 is to determine whether the engine is cold. Thus, in other embodiments, other temperature sensors can be used in lieu of the water temperature at the decision step 42. For instance, another embodiment could use the oil temperature to determine whether the engine is cold. If this condition is false, skip firing will not be initiated because the engine is cold; processing returns to the start timer step 40. If the result of the decision step 42 is true, processing moves to a step 44 where the fuel value (from the fuel system 14) is compared to the skip-on threshold fuel value. Skip-on threshold values will be discussed below in conjunction with Table 1. The skip-on threshold value is determined from the reference data store 18 as a function of the current notch position. If the result of the decision step 44 is false, processing returns to the start timer step 40. If the result of the decision step 44 is true, processing moves to a decision step 46 where a determination is made whether the throttle notch handle position has changed since the timer was started. If the result from the decision step 46 is false, processing moves back to the start timer step 40. On the other hand, if the result is true, processing moves to a decision step 48 where the desired speed (as determined by the position of the throttle) is compared to a reference speed. Typically, the process identified by the decision step 48 is performed in the electronic governing unit speed regulator, which regulates the engine speed by determining the fuel value injected into each cylinder. The fuel value is based on the difference between a reference speed and the actual engine speed. If these values are not equal, processing returns to the start timer step 40. If these results are equal, indicating that the diesel engine is operating at a steady speed (i.e., not in a transient condition), processing moves to a decision step 50. If the timer has expired when processing reaches the step 50, then it is reset when processing returns to the start timer step 40. If the timer has not expired, processing moves from the decision step 50 to a step 52 where the skip firing pattern is initiated by controlling fuel injection through the signal sent to the fuel pumps 24, as shown in FIG. 1. In summary, all of the conditions set forth in the FIG. 2 flow chart must have existed for a duration greater than the time period established by the timer. As is known to those skilled in the art, there are other techniques for implementing the concepts expressed in the flowchart. If the timer expires before all of these conditions are true, then processing returns to the start timer step 40 and skip firing will not be implemented. In one embodiment, the timer is set for 30 seconds.

Figure 3:
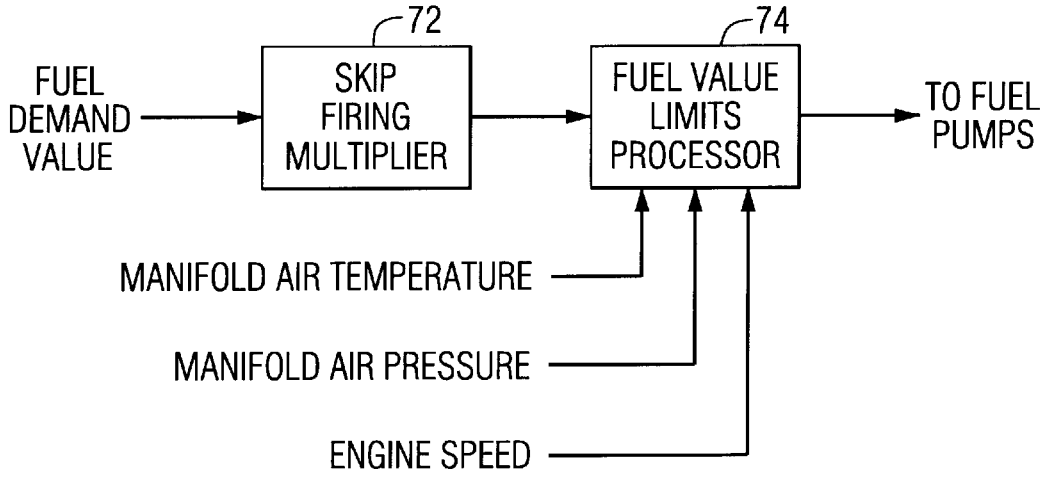
FIG. 3 illustrates a speed regulator associated with the present invention.

As shown at the step 52, in addition to starting the skip firing pattern, the engine advance angle is changed by a predetermined value. The step 52 also indicates that when skip firing is implemented, the speed loop integrator is multiplied by a factor. This aspect of the present invention is illustrated in FIG. 3. As discussed above, the engine governing unit speed regulator compares the actual diesel engine speed with a reference speed to generate a speed error signal, which is then used to generate a fuel demand signal for controlling the injection pumps. Based on the error signal, the electronic governing unit speed regulator adjusts the fuel demand value cylinder-by-cylinder in a direction to reduce the error signal to zero. However, when the engine goes into the skip firing mode, the engine speed will immediately drop because fewer cylinders are firing. As a result, the error signal increases the electronic governing unit speed regulator demands more fuel to be injected into the operating cylinders to bring the error signal back to zero. However, the control loop may take a considerable time for the actual speed to catch up to the reference speed. In accord with the present invention, and to avoid this lag time, when skip firing is initiated the electronic governing unit speed regulator immediately adjusts the fuel demand value by multiplying the fuel demand value by the ratio of number of available cylinders divided by the number of cylinders firing per crank shaft cycle. For example, if only half of the available cylinders are firing during a crank shaft cycle, the effective ratio is two. The skip firing multiplier 72 multiplies the fuel value by two, thereby reducing the time for the speed regulator to produce a zero error signal. The skip firing multiplier block 72 in FIG. 3 represents the process of multiplying the fuel demand value by the aforementioned multiplier. If, in a more complex embodiment, more than one skip firing pattern is available and used, each pattern will have a unique multiplier due to each pattern having a different number of effective cylinders. Further, in another embodiment, the actual multiplier value may vary slightly from the effective ratio due to friction and other factors that can be considered and therefore used to change the multiplier value. The new fuel demand value is input to a fuel value limits processor 74, where a fuel value limit is determined based on the manifold air temperature, the manifold air pressure and engine speed. See, for example, commonly owned patent application entitled "Variable Fuel Limit for Diesel Engine" filed on Sep. 25, 2000 and bearing application Ser. No. 09/669,999. The fuel value limits processor 74 is operative to set a limit beyond which the fuel value cannot go to avoid engine overfueling. The output from the fuel value limits processor 74 is in fact a fuel value that is input to the fuel pumps for controlling injection within the engine cylinders.

Figure 4:
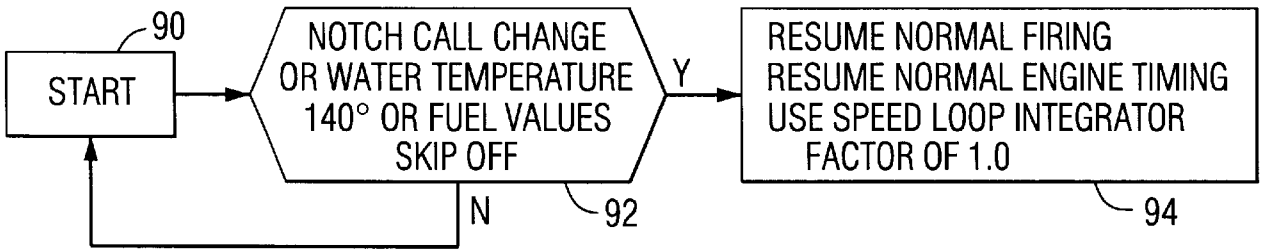
FIG. 4 is a flow chart illustrating the conditions under which skip firing is discontinued.

The algorithm for discontinuing skip firing is illustrated in FIG. 4. The algorithm begins at a start step 90 and proceeds to a decision step 92. The conditions under which skip firing are terminated, as evaluated at the decision step 92 are as follows: a change in the throttle notch call, or the water temperature drops below 140° F., or the fuel value exceeds the skip-off threshold value. If any one of these conditions is satisfied, processing moves from the decision step 92 to a step 94. As indicated by the step 94, the normal firing pattern is resumed, the engine timing value is changed to its normal value, and a value of one is now used as a multiplier in the skip firing multiplier 72. If none of the three conditions set forth at the decision step 92 are satisfied, processing returns to the start step 90.

The skip-on and skip-off threshold values referred to in FIGS. 2 and 4 are selected to assure proper operation of the diesel engine at each notch position. As a result, these fuel value thresholds will vary dependent upon the application in which the present invention is employed.

Figure 5:
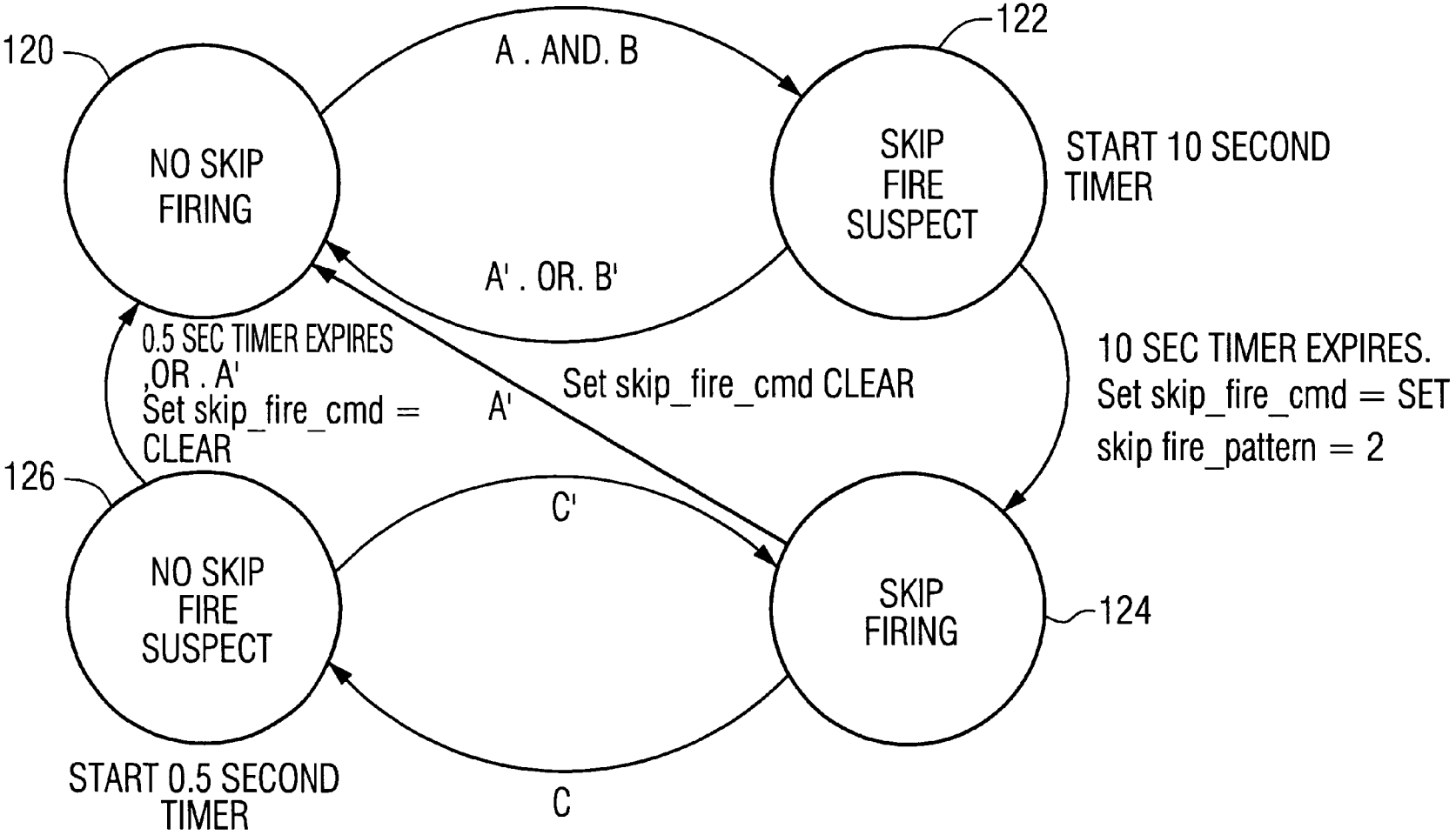
FIG. 5 is a state diagram illustrating operation of a second embodiment of the present invention.

FIG. 5 illustrates another embodiment of the present invention operative in those embodiments where the software block 10 does not have information of the notch position of the locomotive throttle. The state diagram of FIG. 5 is dependent upon certain conditions, referred to therein as conditions A, B, and C. Each of these conditions will now be discussed in detail below.

Condition A requires the following:

Pop test=not active, AND

Water temp greater than 140° F. AND

State=traction alternator not supplying power.

The first requirement for satisfying condition A is the pop test in an inactive mode. The pop test is initiated to test the firing of each cylinder. It is executed by injecting a greater than normal amount of fuel into each cylinder. When the cylinder fires, a "pop" sound is heard, indicating that the cylinder is firing properly. The second required condition for satisfying condition A is a water temperature above 140° F. The third required condition is satisfied when it is known that the traction alternator is not supplying power. Dependent upon the locomotive control system, there are a variety of techniques for determining this state. For example, when the dynamic brakes are applied and the DC link power is being supplied by the traction motors, and no link power is being supplied by the engine, the locomotive is in a non-powered state. Recall that as discussed above, skip firing is implemented only in a non-powered state.

Condition B involves the engine speed in revolutions per minute and the fuel value. Specifically, to satisfy condition B, the desired engine speed must be less than the actual engine speed plus 20, and the fuel value must be less than 25 percent of the fuel value limit.

Finally, Condition C also relates to the engine speed (in revolutions per minute) and the fuel value. Condition C is satisfied when the desired number of revolutions per minute (speed) is greater than the actual number of revolutions per minute (speed) plus 20 or when the fuel value is greater than 50 percent of the fuel value limit.

The locomotive controller implementing the state diagram of FIG. 5 includes a skip fire option setting. If the option is not set, then the state machine will not execute, and therefore skip firing will not be initiated. Turning to FIG. 5, the state machine includes a state 120 where there is no skip firing. If conditions A and B are satisfied, execution moves to a state 122 where skip firing may be a viable option. At the state 122, a ten second timer is started. If the system remains at the state 122 for the entire duration that the timer is running, then the skip fire command is set and the diesel engine fuel injectors are controlled to implement one of the skip fire patterns discussed above. The implementation of skip firing is shown at a state 124. Returning to the state 122, if during the duration of the timer countdown one or both of the conditions A and B are not satisfied, then the machine returns to the state 120. This situation is illustrated by the line connecting the state 122 with the state 120 labeled NOT A or NOT B.

Skip firing continues at the state 124 until condition NOT A occurs. If this happens, the skip fire command is cleared. If the condition C is satisfied while the system is at the skip firing step 124, then the system moves to state 126 where a further evaluation is made as to whether skip firing should be continued. At the state 126, a half second timer is started. If that timer expires or condition NOT A is satisfied, then the skip fire command is cleared and skip firing terminates. If, however, while the system is at the state 126, a NOT C condition occurs, then the system returns to the skip firing state 124. Note that, for instance, a NOT C condition requires both of the statements associated with condition C to be false.

While the invention has been described with reference to a preferred embodiment, it will be understood by those skilled in the art that various changes may be made and equivalent elements may be substituted for elements thereof without departing from the scope of the invention. In addition, modifications may be made to adapt a particular situation to the teachings of the invention without departing from the essential scope thereof. Therefore, it is intended that the invention not be limited to the particular embodiment disclosed as the best mode contemplated for carrying out this invention, but that the invention include all embodiments falling within the scope of the appended claims. For example, the invention may be applied to marine or automotive internal combustion engines. Further, application of the invention described herein is not limited to a specific engine size or cylinder count. It is also applicable to both four stroke and two stroke engines, and can be expanded by the use of different skip firing patterns under different conditions to further optimize performance.

What is claimed is:

1. A method of selectively operating a diesel engine in a skip firing mode, the engine having a plurality of individually controllable cylinders, wherein the engine includes a speed regulation control system and operates at a predetermined engine timing angle prior to initiation of the skip firing mode, the method comprising the steps of:

ascertaining selected prevailing engine operating conditions by determining whether there has been a change in throttle position during a predetermined time interval; and when certain of said operating conditions have a predetermined relationship with predetermined reference values for a predetermined period of time;

implementing at least one predetermined skip firing pattern;

advancing the engine timing angle; and including a multiplication factor in the engine speed regulation control system.

* * * * *